US009126383B2

(12) United States Patent
Yeager

(10) Patent No.: US 9,126,383 B2
(45) Date of Patent: Sep. 8, 2015

(54) BOTTOM-GUSSETED PACKAGE AND METHOD

(71) Applicant: Innoflex Incorporated, Mobile, AL (US)

(72) Inventor: James W. Yeager, Mobile, AL (US)

( * ) Notice: Subject to any disclaimer, the term of this patent is extended or adjusted under 35 U.S.C. 154(b) by 0 days.

(21) Appl. No.: 14/266,477

(22) Filed: Apr. 30, 2014

(65) Prior Publication Data

US 2014/0294326 A1 Oct. 2, 2014

Related U.S. Application Data

(63) Continuation-in-part of application No. 14/034,154, filed on Sep. 23, 2013.

(60) Provisional application No. 61/734,114, filed on Dec. 6, 2012.

(51) Int. Cl.

| | |
|---|---|
| ***B31B 37/00*** | (2006.01) |
| ***B31B 29/60*** | (2006.01) |
| ***B65D 30/20*** | (2006.01) |
| ***B31B 29/00*** | (2006.01) |
| ***B65D 47/00*** | (2006.01) |
| ***B31B 1/00*** | (2006.01) |

(52) U.S. Cl.

CPC . *B31B 29/60* (2013.01); *B31B 1/00* (2013.01); *B31B 29/00* (2013.01); *B65D 31/10* (2013.01); *B65D 47/00* (2013.01); *B31B 2219/6038* (2013.01); *B31B 2221/20* (2013.01); *B31B 2237/20* (2013.01); *B31B 2237/403* (2013.01); *B31B 2237/50* (2013.01); *B65D 2575/586* (2013.01)

(58) Field of Classification Search

CPC B31B 2221/20; B31B 37/00; B31B 2237/20; B31B 29/00; B31B 2221/40; B31B 2237/50; B65D 31/08

See application file for complete search history.

(56) References Cited

U.S. PATENT DOCUMENTS

| | | | | |
|---|---|---|---|---|
| 3,688,650 | A * | 9/1972 | de Vries | 493/200 |
| 4,055,109 | A | 10/1977 | Kan | |
| 4,266,469 | A * | 5/1981 | Feldkamper | 493/219 |

(Continued)

FOREIGN PATENT DOCUMENTS

| | | | |
|---|---|---|---|
| JP | 2004161288 | A | 6/2004 |
| JP | 2004203393 | A | 7/2004 |

(Continued)

OTHER PUBLICATIONS

Machine Translation of Japanese Document No. 2012-152901. Translated on Feb. 5, 2015.

(Continued)

*Primary Examiner* — Sameh Tawfik

(74) *Attorney, Agent, or Firm* — Wood, Phillips, Katz, Clark & Mortimer

(57) ABSTRACT

A bottom-gusseted package comprises a package body, and a bottom gusset positioned transversely of a longitudinal axis of the package body. Formation of the bottom-gusseted package is effected by positioning individual sleeves transversely of the longitudinal axis of a flexible web which forms the package body. During package formation, the flexible web is cut to form individual packages, with each individual sleeve positioned to form a bottom gusset in a respective package.

13 Claims, 5 Drawing Sheets

$G_W \leq BP_W - [(2 \times T_{TD}) - C_{TD}]$ $G_{SS} \geq (2 \times T_{TD}) + C_{TD}$

(56) References Cited

U.S. PATENT DOCUMENTS

| | | | | |
|---|---|---|---|---|
| 4,617,683 | A | 10/1986 | Christoff | |
| 4,651,504 | A | 3/1987 | Bentsen | |
| 4,909,017 | A | 3/1990 | McMahon et al. | |
| 4,913,693 | A * | 4/1990 | Ball et al. | 493/194 |
| 5,236,531 | A | 8/1993 | Yokoyama | |
| 5,437,406 | A | 8/1995 | Gordon et al. | |
| 5,826,401 | A | 10/1998 | Bois | |
| 5,902,047 | A | 5/1999 | Yeager | |
| 6,286,191 | B2 | 9/2001 | Van Erden | |
| 6,328,683 | B1 * | 12/2001 | Rautenberg | 493/255 |
| 6,425,847 | B1 * | 7/2002 | Broenstrup | 493/231 |
| 6,517,660 | B2 * | 2/2003 | Ausnit | 156/270 |
| 6,719,678 | B1 | 4/2004 | Stern | |
| 6,783,276 | B2 | 8/2004 | Machacek et al. | |
| 6,928,791 | B2 | 8/2005 | Ausnit | |
| 6,971,794 | B2 | 12/2005 | Yeager | |
| 7,331,917 | B2 | 2/2008 | Totani | |
| 7,775,957 | B2 * | 8/2010 | Totani | 493/210 |
| 8,182,407 | B2 | 5/2012 | Yeager | |
| 8,616,768 | B2 | 12/2013 | Inagaki et al. | |
| 2003/0104914 | A1 * | 6/2003 | Schwenke et al. | 493/150 |
| 2007/0092166 | A1 | 4/2007 | Auzini et al. | |
| 2011/0019943 | A1 | 1/2011 | Piraneo | |

FOREIGN PATENT DOCUMENTS

| | | |
|---|---|---|
| JP | 2010105741 | 5/2010 |
| JP | 2102152901 A | 8/2012 |

OTHER PUBLICATIONS

International Search Report and Written Opinion for corresponding PCT application No. PCT/US14/56729.

* cited by examiner $$G_W \leq BP_W - [(2 \times T_{TD}) - C_{TD}]$$

$$G_{SS} \geq (2 \times T_{TD}) + C_{TD}$$

BOTTOM-GUSSETED PACKAGE AND METHOD

TECHNICAL FIELD

The present invention relates generally to packages formed from polymeric film webs, and more particularly to a bottom-gusseted package including a bottom gusset positioned transversely of a longitudinal axis of the package, with the configuration of the package, and its method of formation, permitting use with associated form, fill, and seal equipment.

BACKGROUND OF THE INVENTION

Packages formed from plastic, polymeric film material have found widespread application in the market place for convenient and efficient packaging of all manner of food and non-food products. Packages of this nature typically are formed by folding and sealing a web of polymeric material to form a package body having front and rear package panels, with the package panels joined to each other at margins thereof. Depending upon the method of formation, the front and rear package panels may be joined to each other either by folded portions of the package body, or at seals (typically heat seals) joining the package panels to each other.

Non-gusseted packages of this type are sometimes referred to as "pillow packs", and do not include either side gussets or top or bottom gussets. However, for many applications it is desirable to form a gusseted package that is, providing the package with inwardly-extended, pleat-like gussets at one or more margins of the package body. For example, side-gusseted packages include inwardly extending side gussets at opposite lateral sides of the package body, which side gussets join respect lateral edges of the front and rear package panels to each other.

For some applications, it is especially desirable to provide a bottom-gusseted package, that is, a package having an inwardly extending gusset at the bottom of the package body. By virtue of the breadth and stability provided by the bottom gusset, packages of this nature can frequently be configured to be self-standing, promoting efficient display for consumer selection.

Heretofore, bottom-gusseted packages have typically been formed by pleating a web of polymeric material in a direction parallel to the longitudinal axis of the web. Suitable ploughs and forming guides shape and configure the polymeric web as it moves longitudinally, including formation of a continuous, inwardly extending bottom gusset in the web material. Subsequently, suitable seals are formed transversely of the web to define individual package bodies, each including front and rear package panels, with each including a bottom gusset. Individual package bodies are formed by cutting the web of material at the transversely extending seals, with the contents of each package deposited therein either before or after cutting of the web into individual packages. Formation of an upper seal, at the margin of the folded polymeric web opposite the bottom gusset, closes and seals each package body. By this formation technique, the bottom gusset has a width that corresponds to and is the same as the width of the front and rear package panels.

As will be appreciated by this typical formation technique, the height or vertical dimension of each package body is approximately equal to one-half of the width of the polymeric web, less the dimension of the bottom gusset. As a consequence, the maximum height of any package being formed is essentially limited by the maximum width of the web of polymeric material which the forming equipment is capable of handling.

The present invention contemplates a bottom-gusseted package, and a method of formation, which addresses the shortcomings in the conventional forming of bottom-gusseted package. In essence, this is achieved by forming each package with a bottom gusset positioned transversely of the longitudinal axis of the polymeric film web and each package. The bottom-gusseted packages of any selected height can be readily and efficiently formed.

SUMMARY OF THE INVENTION

A bottom-gusseted package embodying the principles of the present invention comprises a package body formed from a flexible web having a longitudinal axis. The flexible web is folded to define a front package panel and a rear package of the package body. The front and rear package panels are joined to each other at respective lateral side margins of the package body, with the flexible web being joined to itself along a seam which extends parallel to the longitudinal axis of the flexible web.

Notably, a package formed in accordance with the present invention includes a bottom gusset positioned between the front and rear package panels, with the bottom gusset extending upwardly and inwardly from the lower edges of the front and rear package panels. By formation of the present package in accordance with the present invention, the bottom gusset is positioned within the package body transversely of the longitudinal axis of the package body, and transversely of the longitudinal axis of the flexible web from which the package body is formed. As a consequence, a package body can be very efficiently formed at any selected height, without necessarily being limited by the width of the flexible web from which the package is formed.

As will be appreciated, package formation can be very efficiently effected in conjunction with package filling on a so-called form, fill and seal packaging machine. It is presently contemplated that a rolled web of fill having gusset-forming sleeves joined thereto can be fed to a form, fill and seal machine for package formation and filling. During use in this manner, individual, filled bottom-gusseted packages are formed.

Notably, the versatility of the method of package formation in accordance with the present invention permits formation of a bottom-gusseted package in different configurations. In one illustrated embodiment, a bottom-gusseted package is formed by folding the flexible web of material generally at the longitudinal axis thereof, and joined lateral margins of the flexible web providing a seam at one side edge of the package. The bottom gusset of the package thus extends generally between the longitudinal axis of the web of material and the package seam. In alternative embodiment, a bottom-gusseted package is formed with the seam at which the web material is joined to itself is positioned in the rear package panel. By virtue of the formation technique, the bottom gusset of the package extends less than the width of the front and rear package panels.

The method of forming a bottom-gusseted package in accordance with the present invention comprises the steps of providing flexible web of material having a longitudinal axis. Suitable polymeric material can be employed by virtue of its liquid-impermeable characteristics, and heat-sealing capabilities.

Together with a flexible web of material, the present method contemplates that a flexible, sleeve-forming web is provided. The sleeve-forming web is folded and generally tubular in configuration. It is presently preferred that an inside surface of the folded, sleeve-forming web does not heat-seal to itself, thus facilitating formation of a bottom gusset which spreads or opens to permit the packages being formed to be generally self-standing.

The present method further comprises the step of cutting the flexible, sleeve-forming web into a plurality of individual sleeves, each having a folded, generally tubular configuration. It is contemplated that each individual sleeve can optionally be provided with one of more features to maintain the sleeve in a folded or closed configuration to facilitate subsequently handling and filling of packages being formed.

The individual sleeves are next joined to the flexible web in spaced apart relationship longitudinally of the flexible web, transversely of the longitudinal axis of the flexible web. The spacing between individual sleeves corresponds to the length of each of the bottom-gusseted packages being formed. Notably, as will be further described, each individual sleeve eventually forms the bottom gusset of a respective one packages. By forming package end seals, as described below, packages can be formed such that each individual sleeve is positioned within a respective package, and does not span or extend between adjacent packages. Efficient formation is thus promoted.

After the individual sleeves are joined to the flexible web, the flexible web is folded and joined along lateral margins thereof to form a generally tubular, folded flexible web. The individual sleeves are positioned generally within the folded flexible web, in spaced apart relationship. Folding of the flexible web material forms a package body for each of the bottom-gusseted packages, with each package body including a front package panel and a rear package panel joined at opposite side margins thereof. Next, the folded flexible web is cut at intervals each corresponding in length to the length of each of the bottom-gusseted packages being formed. The individual sleeves are positioned generally within the folded, flexible web, with the individual sleeves providing the bottom gusset for a respective one of the packages being formed.

As noted, the present method can be practiced such the step of folding the flexible web of material which forms the packages includes folding the flexible web generally at the longitudinal axis thereof, so that each of the individual sleeves extends generally between the longitudinal axis and the joined lateral margins of the flexible web of material. The resultant bottom gusset for each package thus extends generally between the longitudinal axis and the joined lateral margins at the seam at which the web of material is joined to itself, and the side edge of the package. Alternatively, the web of material can be folded and joined to itself such the package seam is positioned in the rear package panel.

Efficient package formation is promoted by configuring each of said individual sleeves to have a length which is less than the width of the folded web of flexible material. This provides formation of said bottom gusset with a width less than the width of the package, to permit formation of side seals between the front and read package panels of each said package at opposite side edges of the bottom gusset of the package. Each of these side seals overlaps a respective end of the bottom gusset of the package.

An important aspect of the preferred practice of the invention promotes efficient, high-speed formation. Specifically, the present method includes intermittently advancing flexible web of material after the individual sleeves have been joined thereto, wherein the flexible web of material is advanced with a tolerance range of dimension $T_{LD}$. This tolerance range is dependent upon the specific operational parameters of the forming apparatus, such as the associated form, fill, and seal machine. Notably, the present method includes forming top and bottom end seals in adjacent ones of the packages being formed by operation of a pair of heat sealing jaws, wherein the spacing between the ends seals of adjacent ones of the packages is at least two times $T_{LD}$. This ensures proper sealing of the ends of each package, with each bottom gusset properly sealed and configured to open or splay for providing the desired interior volume to the package, and desired self-standing characteristics. This spacing can further be selected to accommodate the range in variation of the longitudinal positioning of each of the individual sleeves on the flexible web of material.

As noted, it is presently contemplated that the folded sleeve-forming web from which the bottom gussets are formed has an inside surface of which does not heat-seal to itself. Since package formation, and advancement through the form, fill and seal machine can sometimes orient the bottom gusset in the "leading" direction, in can be desirable to close the individual sleeves against opening during such advancement. This can be achieved by closing each of the individual sleeves prior to joining the individual sleeves to the flexible web of material. Such a closing step can be effected by providing an adhesive seal along at least one end of an inside surface of each said individual sleeves. Such an adhesive seal may comprise a bead of adhesive. Alternatively, the adhesive may comprise a plurality of adhesive dots. As a further alternative, such closing can be effected by temporarily joining an inside surface of each of individual sleeves generally at a central portion of each of the individual sleeves.

The specific composition of the materials from which the package body and bottom gusset are formed can be selected as appropriate for specific applications. For example, the sleeve-forming web, which forms the bottom gussets, can be made from a material which is different than the flexible web which forms the package body.

Thus, a recloseable package configured in accordance with the present comprises a package body formed from a flexible web having a longitudinal axis, with the flexible web being folded to define a front package panel and a rear package panel of said package body. The front and rear package panels are joined to each other at respective lateral side margins of the package body, with the flexible web being joined to itself along a seam which extends parallel to the longitudinal axis of the flexible web.

The present package further includes a bottom gusset positioned between the front and rear package panels, with the bottom gusset extending less than the width of the front and rear package panels. Laterally opposite side seals, that join the front and read package panels to each other at the respective lateral side margins of said package body, each overlap a respective end of said bottom gusset.

Since an inside surface of the bottom gusset ordinarily does not heat-seal to itself, an adhesive seal can optionally be provided along at least one end of an inside surface of said bottom gusset. Optionally, a temporary seal joining an inside surface of bottom gusset generally at a central portion thereof can be provided for closing the gusset.

In one embodiment, the flexible web from which the package body is formed is folded generally at the longitudinal axis thereof, with bottom gusset extending generally between the longitudinal axis, and the joined lateral margins at the package seam at which web of material is joined to itself. Alternatively, the seam at which the web of material is joined to itself is positioned in the rear package panel.

Other features and advantages of the present invention will become readily apparent from the following detailed description, the accompanying drawings, and the appended claims.

DETAILED DESCRIPTION

Figure 1:
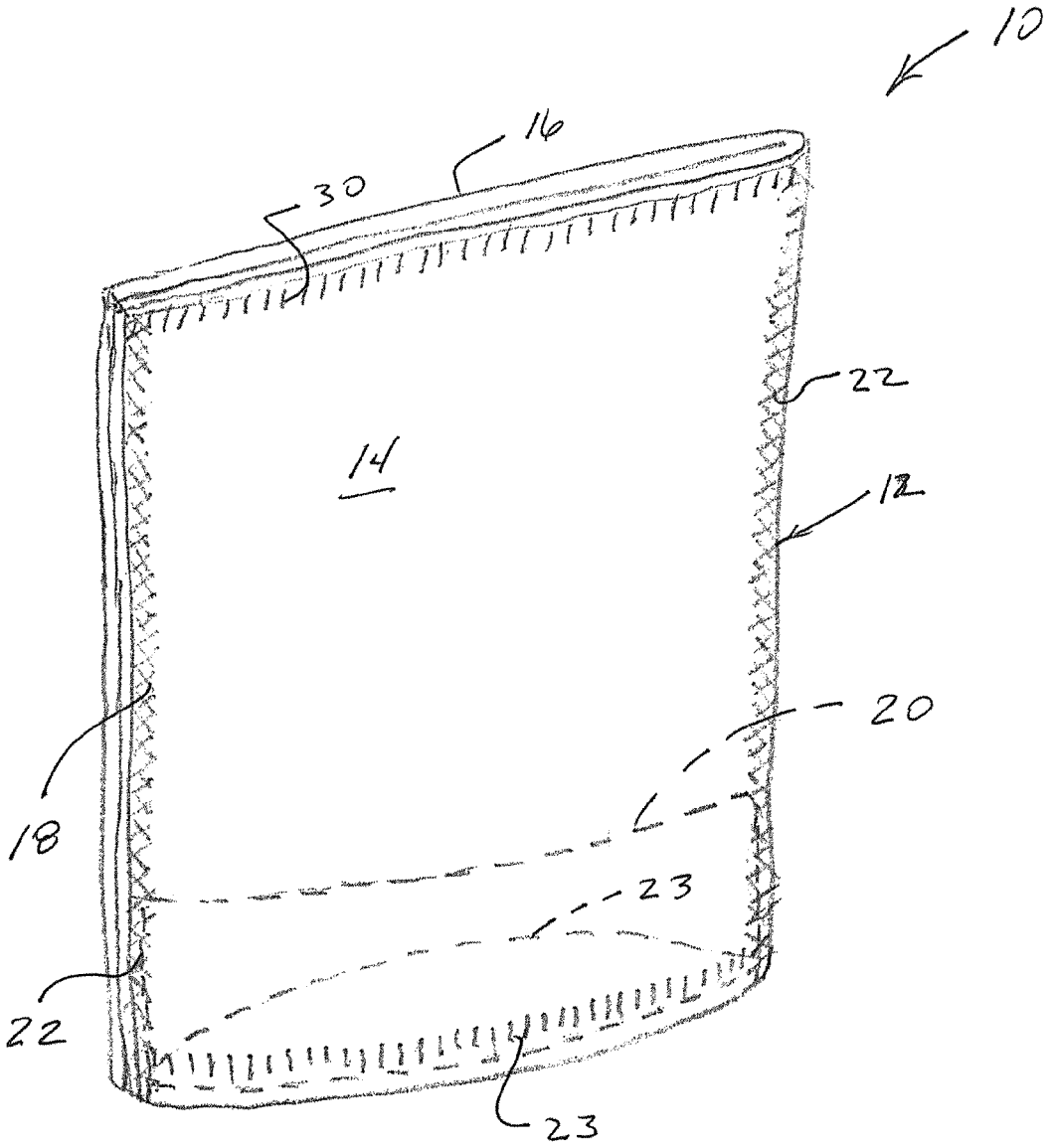
FIG. 1 is a perspective view of a bottom-gusseted package, embodying the principles of the present invention.

While the present invention is susceptible of embodiment in various forms, there is shown in the drawings and will hereinafter be described the presently preferred embodiments, with the understanding that the present disclosure should be considered as an exemplification of the invention, and is not intended to limit the invention to the specific embodiments illustrated.

U.S. Pat. No. 4,909,017, U.S. Pat. No. 4,617,683, U.S. Pat. No. 5,902,047, U.S. Pat. No. 6,971,794, and U.S. Pat. No. 8,182,407, illustrate various package constructions and formation methods, and are all hereby incorporated by reference.

Figure 2:
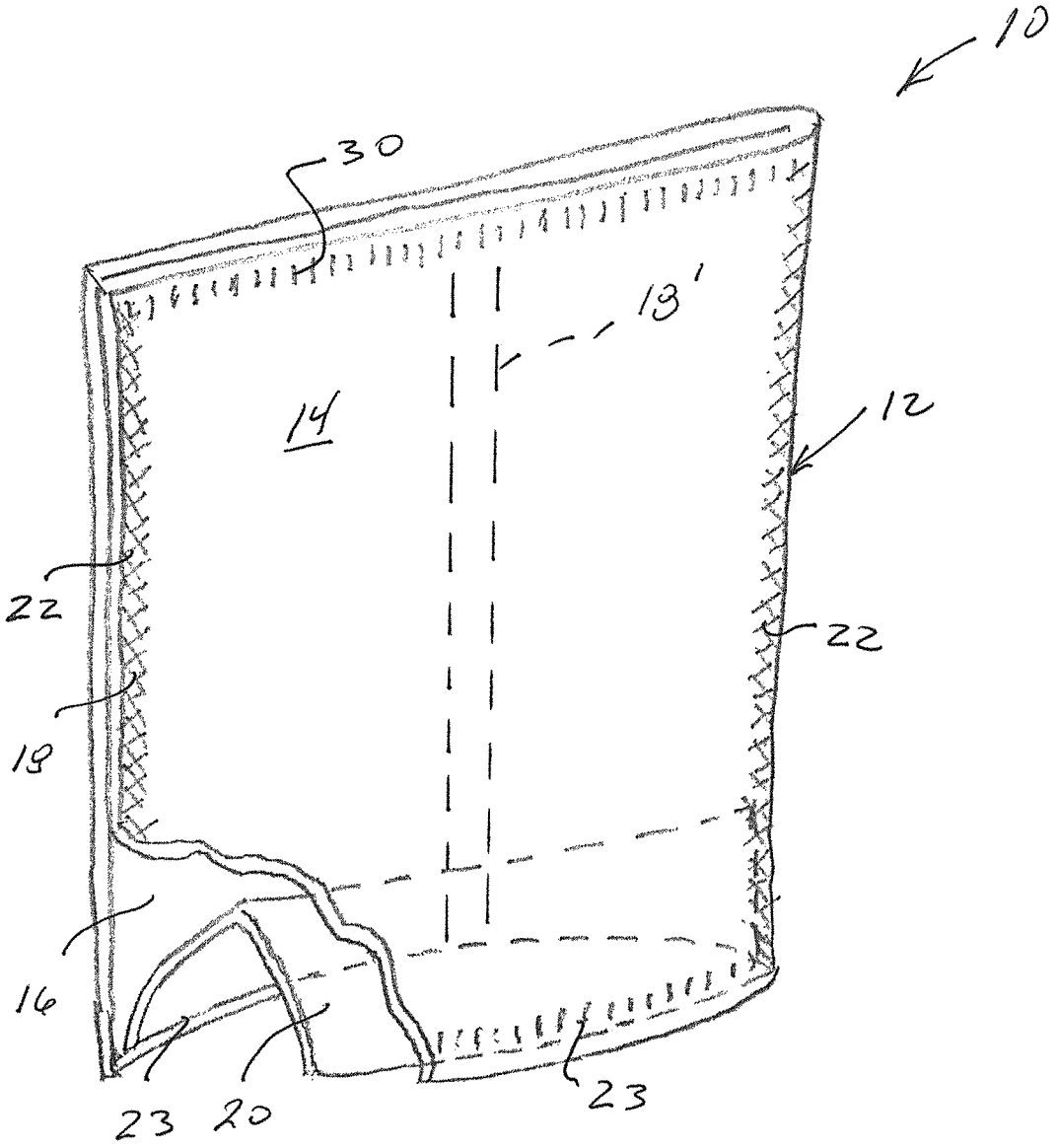
FIG. 2 is a perspective view similar to FIG. 1, with portions of the package cut away to illustrate the bottom gusset of the package.

With reference first to FIGS. 1 and 2, therein is illustrated a bottom-gusseted package 10 embodying the principles of the present invention. As will be further described, bottom-gusseted package 10 is configured to facilitate formation and filling on an associated, so-called form, fill and seal packaging machine, as is known in the art. Typically, the present invention can be practiced by partial formation of the present package as a rolled web of flexible, polymeric film material, with individual sleeves positioned thereon, which is supplied to the form, fill and seal apparatus. The formation of each package is completed attendant to filling of each of the packages with the desired quantity of product.

With further reference to FIGS. 1 and 2, the bottom-gusseted package 10 illustrated therein includes a package body 12 formed from a flexible film web having a longitudinal axis, wherein the flexible web has been folded to define a front package panel 14 and a rear package panel 16 of the package body 12. The front and rear package panels 14 and 16 are joined to each other at respective lateral side margins of the package body 12. In the illustrated embodiment, the front and rear package panels are joined to each other where the flexible film web from which the body is formed has been folded generally at its longitudinal axis, at one side edge of the package. The flexible film web from which the package body 12 is formed is joined to itself along a longitudinal seam 18 which extends parallel to the longitudinal axis of the flexible web. While seam 18 has been illustrated generally at the lateral, side edge of the package, opposite the fold formed along the longitudinal axis, the flexible web can otherwise be joined to itself, such as along a longitudinal seam 18' positioned in the rear package panel 16, as shown in phantom line in FIG. 2.

In accordance with the present invention, package 10 includes a bottom gusset 20 which is positioned between the front and rear package panels 14 and 16, and which extends upwardly and inwardly from lower edges of the front and rear package panels. As will be further described, the pleat-like bottom gusset 20 is formed from a sleeve of material which is positioned within the flexible web from which the package body is formed.

The bottom gusset 20 is joined to and integrated with the package body by a pair of side seals 22 at opposite lateral margins of the package body. In the illustrated embodiment, one of the side seals 22 coincides with, and can be provided by, the longitudinal seam 18 of the package 10. For some applications, it may be desirable to form side seals 22, adjacent bottom gusset 20, which do not extend the full length of the package. A pair of bottom end seals 23 respectively join the edges of the bottom gusset 20 to the front and rear package panels 14 and 16, to provide a bottom seal for the package, with the upper edge portions of the front and rear package panels joined at a heat-sealed top end seal 30. By virtue of the formation technique, the bottom gusset 20, including those portions of the gusset sealed at the side seals 22, extends less than the width of the front and rear package panels 14, 16. In previous bottom gusseted packages, the bottom gusset typically extends the full width of the package, so that the length of the gusset is same as the width of the front and rear package panels.

As will be appreciated, access to the contents of the package 10 can be provided configuring the package to include a suitable preferentially weakened region, such as a score line or the like. For some applications, it can be desirable to provide the front panel of the package with a recloseable fastener assembly, such as disclosed in the afore-mentioned patents. Other suitable opening arrangements can be provided as may be desired.

Figure 3:
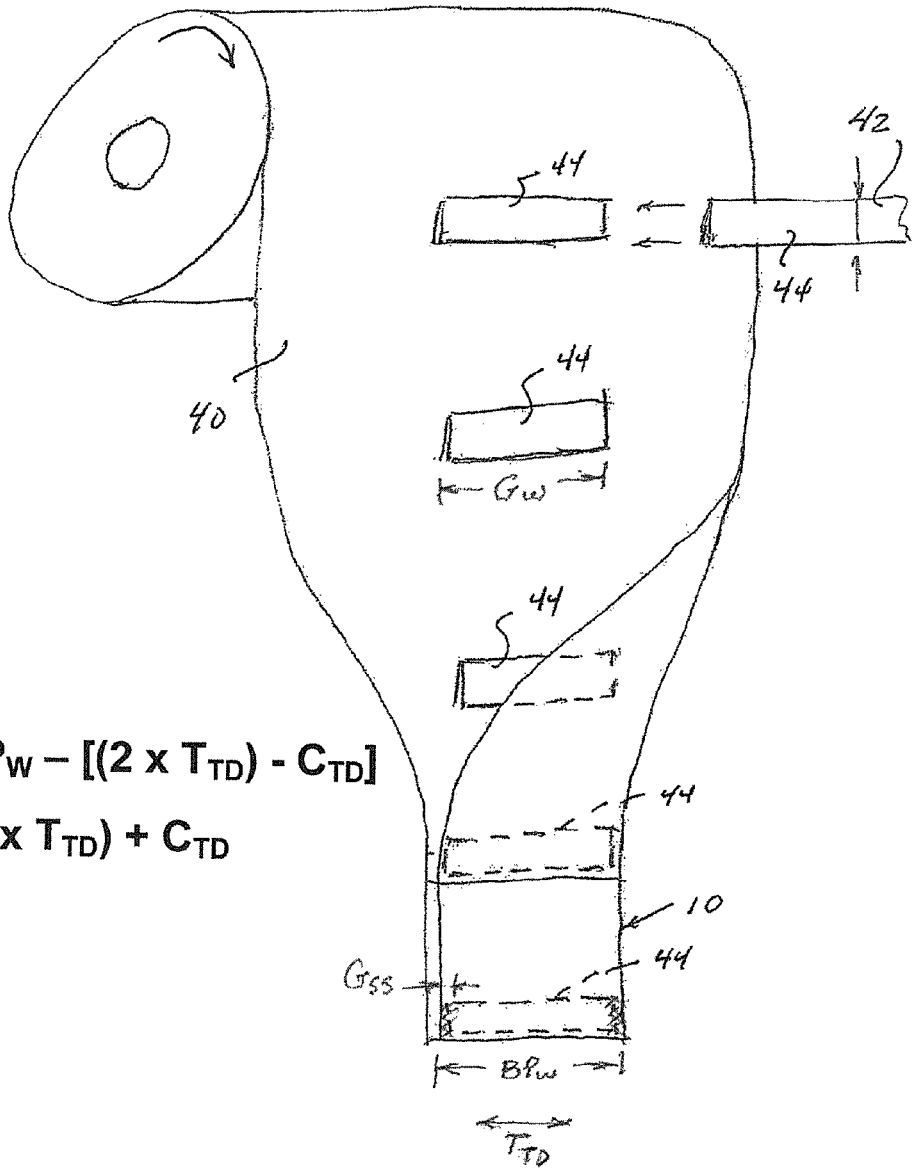
FIG. 3 is a diagrammatic view illustrating formation of the package shown in FIGS. 1 and 2, in accordance with the present invention.
Figure 4:
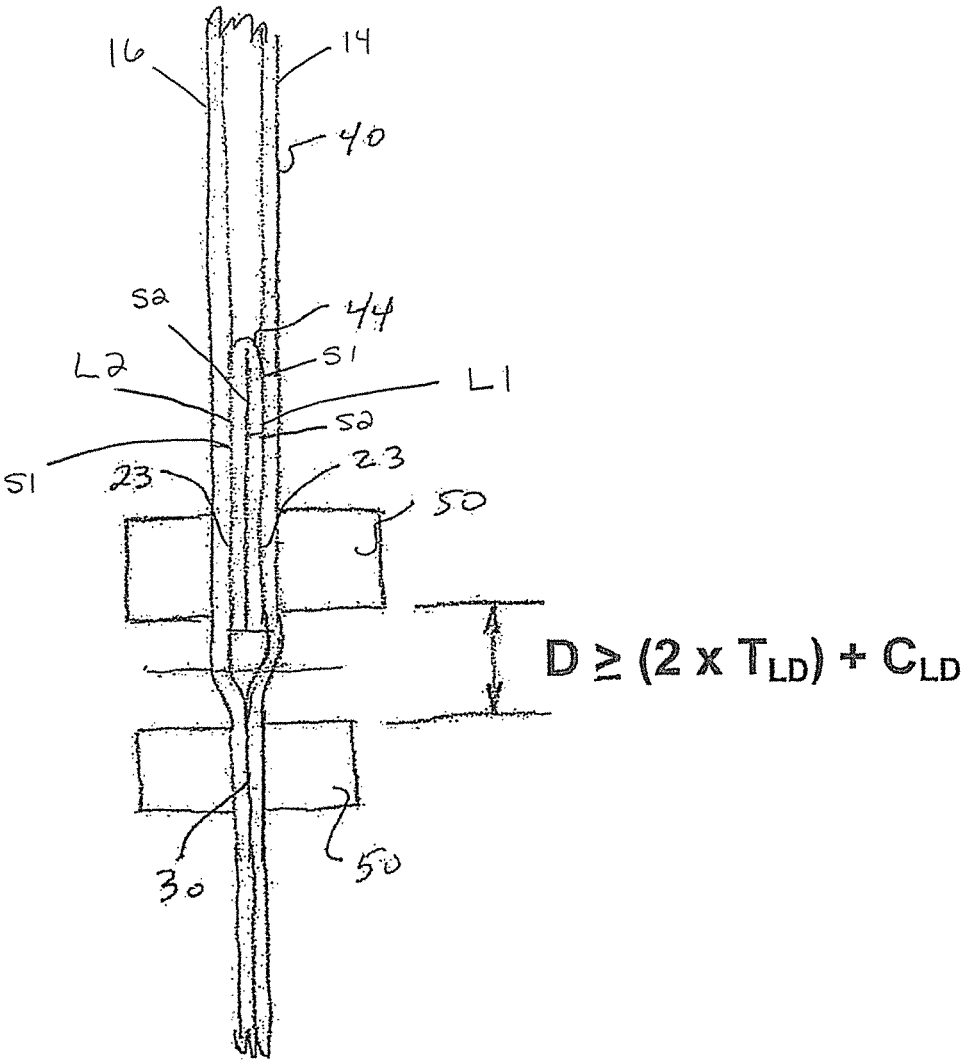
FIG. 4 is a diagrammatic view further illustrating formation of a recloseable, bottom-gusseted package.
Figure 5:
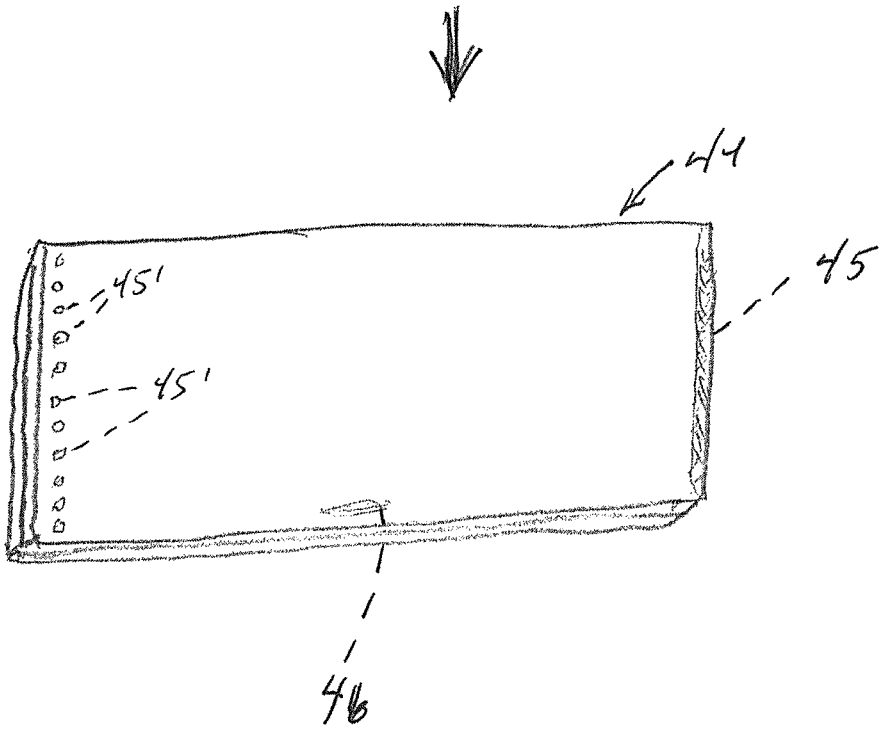
FIG. 5 is a view illustrating features for facilitating formation and filling of packages made in accordance with the present invention.

With reference now to FIGS. 3-5, formation of the bottom-gusseted package 10 will be described. For package formation, a flexible web 40 preferably comprising heat-sealable polymeric material is provided, with a flexible web typically advanced in a direction along its longitudinal axis. Formation of the present bottom-gusseted package is further effected by providing a flexible, sleeve-forming web 42, also preferably comprising suitable polymeric, heat-sealable material. The composition of the sleeve-forming web can differ from the flexible web 40 for forming the package of the body, as may be desired. It is presently contemplated that only one side of the sleeve-forming web be heat-sealable, so that the inside surface of the folded, sleeve-forming web does not heat seal to itself. This permits the eventual opening and spreading of the legs of the bottom gusset 20 so that the package 10 can assume a generally self-standing orientation.

As shown on FIG. 3, the sleeve-forming web 42 may be provided with a tubular configuration. Individual sleeves 44 are cut from the sleeve-forming web 42, and are positioned transversely of the longitudinal axis of the flexible web 40 from which the package body is formed. For some applications, it can be desirable to close or seal each individual sleeve 44, such as with suitable adhesive. This can be desirable to maintain the sleeves in a generally closed, flattened configuration, as packages are being formed, including during advancement through the associated form, fill and seal apparatus.

Each of the sleeves 44 has first and second walls/legs L1, L2 folded relative to each other into a "V" shape with each of the legs L1, L2 having oppositely facing surfaces S1, S2. The front package panel 14 is joined to only the one surface S1 and not to the other surface S2 on the leg L1. Similarly, the rear package panel 16 is joined to only the one surface S1 and not to the other surface S2 on the leg L2. In the completed bottom-gusseted package, the flexible web does not overlie the other of the oppositely facing surfaces S2 on either of the legs L1, L2.

FIG. 5 diagrammatically illustrates various contemplated arrangements for closing each of the sleeves 44. For example, at least one of the ends each sleeve 44 can be closed by suitable adhesive at the inside surface thereof, such as by a bead of adhesive 45, and a plurality of adhesive dots 45'. Alternatively, a central portion of each of the sleeve can be provided with a temporary seal or adhesive 46. Instead of adhesive, pin-holes seals can be provided to provide the desired closing of each sleeve, with any closing or seal provided at the central portion of each sleeve being temporary in nature so that the resultant gusset can open and splay at intended subsequent to product filling. Other suitable arrangements for closing the sleeves 44 can be employed.

The individual sleeves 44 are joined to the flexible web 40 in spaced apart relationship longitudinally of the web 40. The spacing between the individual sleeves 44 corresponds to the length of each of the bottom-gusseted packages 10 being formed. Each of the sleeves 44 is joined, such as by heat-sealing, to the web 40, such as by seals provided at the ends of each sleeve. The sleeves 44 can otherwise be joined to the web 40, with the understanding that the sleeves are to be joined in a manner which does not inhibit the eventual opening and splaying of each sleeve as it becomes the bottom gusset of a resultant package.

After each of the individual sleeves 44 is joined to the flexible web 40, the flexible web is folded and the lateral margins thereof joined together to form a folded flexible web. In this way, a package body is formed for each of the bottom-gusseted packages. By folding of the flexible web 40, the front and rear package panels 14 and 16 of each package are formed. The folded flexible web 40 can be joined to itself so as to form longitudinal seam 18, with the front and rear package panels joined to each other at the lateral margins of the folded web. As illustrated, the individual sleeves 44 are positioned within the folded flexible web 40.

It is presently contemplated that formation in this manner can be effected, if desired, during packaging on a form, fill, and seal machine, or that individual packages can be formed for subsequent filling. Depending upon the specific formation technique, side seals 22 are typically formed prior to filling, with each of the side seals overlapping the respective end of the bottom gusset 20, with one of end seals 23 formed after the contents of each package have been positioned therein.

In connection with formation of the bottom end seals 23, an important aspect of the preferred practice of the invention promotes efficient, high-speed formation. Specifically, the present method includes intermittently advancing the flexible web of material 40 after the individual sleeves 44 have been joined thereto, such as during advancement through the associated form, fill and seal machine. During this process, the flexible web of material is advanced with a longitudinal tolerance range of dimension $T_{LD}$, that is, is advanced with a precision that varies, plus or minus, by a generally known amount. This specific tolerance range is typically dependent upon the specific operational parameters of the forming apparatus, such as the associated form, fill, and seal machine, with the tolerance range typically increasing at increasing operating speeds. Additionally, it will appreciated that there can be some inaccuracy in the longitudinal positioning of the individual sleeves 44 on the flexible web of material 40, with this range of longitudinal variation, which may be zero, designated $C_{LD}$.

Notably, the present method includes forming top and bottom seals end 30, 23 in adjacent ones of the packages being formed by operation of a pair of heat sealing jaws 50, wherein the spacing between the top and bottom end seals of adjacent ones of the packages is equal to or greater than the sum of: (1) two times the tolerance range with which the flexible web of material 40 is advanced (e.g., $2\times T_{LD}$), and (2) the range of variation of the longitudinal placement of each sleeve 44 (e.g., $C_{LD}$.) This is diagrammatically illustrated in FIG. 4, which shows the two pairs of heat sealing jaws 50, 50 are positioned to provide a dimension D between the end seals 23, 30 of adjacent packages, which is equal to or greater than this sum. This ensures proper sealing of the ends of each package, with each bottom gusset properly sealed and configured to open or splay for providing the desired interior volume to the package, and desired self-standing characteristics. Thus, the spacing between the top and bottom end seals of adjacent ones of the packages is equal to or greater than two times $T_{LD}$, plus $C_{LD}$.

As will be recognized by those familiar with the art, this type of machine intermittently advances packaging material through the machine, with typical variation with respect to the web-cutting apparatus being plus/minus 0.25 inches. Thus, a typical sleeve portion 44 can be provided with a folded width of approximately 3 inches, with seals formed joining each sleeve portion 44 to the flexible web of material 40 being of sufficient length and width to accommodate this variation, while still ensuring that a sufficiently large portion of each seal remains, after cutting of the web, to form the bottom end seals 23 and the top seals 30 of the necessary size to ensure package integrity. As will be appreciated, this dimensioning is meant to be illustrative, but it will be recognized that the present invention can readily be practiced to accommodate this typical cutting position variation of a typical forming apparatus.

Efficient package formation is promoted by configuring each of said individual sleeves to have a length which is less than the width of the folded web of flexible material. This provides formation of the bottom gusset with a width less than the width of the package, to permit formation of side seals 22 between the front and rear package panels 14, 16 of each said package at opposite side edges of the bottom gusset 20 of the package. As noted each of these sides seals 22 overlaps a respective end of the bottom gusset 20 of the package 10.

The preferred dimensioning of the individual sleeves 44 for formation of respective bottom gussets 20, and the preferred dimensioning of the side seals 23 joining the front and rear package panels 14, 16 is illustrated in FIG. 3. As discussed above in connection with end seals of the packages, this preferred dimensioning accommodates manufacturing variations and tolerances.

As will be appreciated, the flexible web of material 40 can exhibit some transverse variation in its positioning as it is intermittently advanced, with this transverse tolerance range being designated $T_{TD}$. Additionally, each of the individual sleeves 44 being positioned transversely of said flexible web of material may exhibit some variation in the positioning transversely of the web of material 40, with this transverse tolerance range being designated $C_{TD}$.

Given these inevitable minor variations in the manufacturing process, it is contemplated that the width of the package gusset, designated $G_W$, which corresponds to the length of each individual sleeve 44, be selected to correspond to the width of the front and rear package panels, designated $BP_W$. As shown, this relationship can be stated as the gusset width $G_W$ is less than or equal to: (1) the package panel width $BP_W$, (2) less two times the tolerance range $T_{TD}$, and (3) less the tolerance range $C_{TD}$.

In turn, the side seals 22 which are formed in each package joining the front and rear package panels 14, 16 at opposite side edges of the bottom gusset of the package are dimensioned to ensure the preferred overlapping of the side seals with the opposite ends of the respective bottom gusset. As shown, the width dimension of each side seal, designated $G_{SS}$, is equal to or greater than: two times the transverse tolerance range $T_{TD}$, plus the transverse tolerance range $C_{TD}$. Again, this ensures the preferred overlapping of the side seals with the associated gussets, notwithstanding the normal manufacturing tolerances exhibited by the equipment employed for practicing the present invention.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making bottom-gusseted packages, comprising the steps of:

providing a flexible web of material having a longitudinal axis, providing a flexible, sleeve-forming web;

cutting said flexible, sleeve-forming web into a plurality of individual sleeves;

joining said individual sleeves to said flexible web in spaced apart relationship longitudinally of said flexible web, with the spacing between said individual sleeves corresponding to a length of each of said bottom-gusseted packages being formed;

folding said flexible web of material and joining lateral margins thereof to form a folded flexible web, and to thereby form a package body for each of said bottom-gusseted packages, each package body including a front package panel and a rear package panel joined at opposite side margins thereof, said individual sleeves being positioned generally within said folded flexible web; and cutting said folded flexible web at intervals each corresponding in length to said length of each of said bottom-gusseted packages, so each individual sleeve provides a bottom gusset for a respective one of the packages being formed wherein each of said individual sleeves has a length which is less than the width of the folded web of flexible material to facilitate formation of said bottom gusset with a width less than the width of the package, said method including formation of side seals directly between the front and rear package panels, including at a longitudinal location where a respective individual sleeve is located, of each said package at opposite side edges of the bottom gusset of the package, a portion of each of said side seals overlapping, and causing the front package panel and rear package panel to adhere to, a respective end of said bottom gusset.

2. A method of making bottom-gusseted packages in accordance with claim 1, wherein said folding step includes folding said flexible web of material and joining the flexible web of material to itself to form each of said packages with a longitudinal seam in the rear package panel.

3. A method of making bottom-gusseted packages in accordance with claim 1, including:

intermittently advancing said flexible web of material after said individual sleeves have been joined thereto, wherein the flexible web of material is advanced with a tolerance range of dimension $T_{LD}$, said method including forming top and bottom end seals in adjacent ones of the packages being formed, wherein the spacing between the top and bottom end seals of adjacent ones of packages is equal to or greater than at least two times $T_{LD}$.

4. A method of making bottom-gusseted packages in accordance with claim 3, wherein:

said individual sleeves are joined to said flexible web of material with a range of longitudinal tolerance designed $C_{LD}$, said spacing between said top and bottom end seals of adjacent ones of said packages being equal to or greater than two times $T_{LD}$, plus $C_{LD}$.

5. A method of making bottom-gusseted packages in accordance with claim 1, wherein:

each said package being formed has a package panel width of $BP_W$, and wherein said flexible web of material is advanced with a transverse tolerance range of $T_{TD}$, each of said individual sleeves being positioned transversely of said flexible web of material with a transverse tolerance range of $C_{TD}$, each of said individual sleeves having a length corresponding to a width $G_W$ of the gusset of each package, wherein $G_W$ is less than or equal to: the package panel width $BP_W$, less two times the tolerance range $T_{TD}$, and less the tolerance range $C_{TD}$.

6. A method of making bottom-gusseted packages in accordance with claim 5, wherein each said package is formed with side seals joining said front and rear package panels of each package at opposite side edges of the bottom gusset of the package, each of said side seals having a width $G_{SS}$ which is equal to or greater than: two times the transverse tolerance range $T_{TD}$, plus the transverse tolerance range $C_{TD}$.

7. A method of making bottom-gusseted packages in accordance with claim 1, wherein:

said sleeve-forming web comprises a folded web of sleeve-forming material, wherein an inside surface of said of said folded sleeve-forming web does not heat-seal to itself.

8. A method of making bottom-gusseted packages in accordance with claim 1, wherein:

each of the individual sleeves has first and second walls folded relative to each other;

further including closing each of said individual sleeves by moving the first and second walls towards each other prior to joining said individual sleeves to said flexible web of material.

9. A method of making bottom-gusseted packages in accordance with claim 8, wherein:

said closing step includes providing an adhesive seal along at least one end of an inside surface of each said individual sleeves.

10. A method of making bottom-gusseted packages in accordance with claim 9, wherein:

said adhesive seal comprises one of: (1) a bead of adhesive, and (2) a plurality of adhesive dots.

11. A method of making bottom-gusseted packages in accordance with claim 8, wherein:

said closing step includes temporarily joining an inside surface of each of said individual sleeves generally at a central portion of each of said individual sleeves.

12. A method of making bottom-gusseted packages in accordance with claim 1, wherein:

said sleeve-forming web is made from a material which is different than said flexible web.

13. A method of making bottom-gusseted packages in accordance with claim 1, further including:

formation of each package with a pair of end seals respectively joining each of said individual sleeves to said front and rear package panels, one of said end seals being formed after contents of each package has been positioned therein.

* * * * *